US005380082A

United States Patent [19]

Milstead

[11] Patent Number: 5,380,082

[45] Date of Patent: Jan. 10, 1995

[54] ASPHALT DRUM MIXER WITH CURVED SCOOP-LIKE MIXING TIPS

[75] Inventor: John Milstead, Chattanooga, Tenn.

[73] Assignee: Astec Industries, Inc., Chattanooga, Tenn.

[21] Appl. No.: 156,431

[22] Filed: Nov. 23, 1993

[51] Int. Cl.[6] ..... B28C 5/46; B28C 5/14

[52] U.S. Cl. ..... 366/25; 366/66; 34/183; 432/118

[58] Field of Search ..... 366/22–25, 366/56–58, 66–67, 225, 228, 305, 312, 313; 432/110, 118; 34/135–137, 182, 183

[56] References Cited

U.S. PATENT DOCUMENTS

| | | | |
|---|---|---|---|
| 3,506,245 | 4/1970 | Noschinski et al. | 366/313 X |
| 3,739,488 | 6/1973 | Kahn | 34/183 X |
| 4,813,784 | 3/1989 | Musil | 366/25 X |
| 4,867,572 | 9/1989 | Brock et al. | 366/25 |
| 5,052,810 | 10/1991 | Brock | 366/25 |
| 5,083,870 | 1/1992 | Sindelar et al. | 366/25 |
| 5,197,205 | 3/1993 | Spada et al. | 34/135 X |
| 5,261,738 | 11/1993 | Brock | 366/25 |

FOREIGN PATENT DOCUMENTS

| | | | |
|---|---|---|---|
| 749229 | 12/1966 | Canada | 366/319 |
| 1177620 | 9/1964 | Germany | 366/325 |

*Primary Examiner*—David A. Scherbel
*Assistant Examiner*—Charles Cooley
*Attorney, Agent, or Firm*—Nilles & Nilles

[57] ABSTRACT

An asphalt drum mixer includes a rotating drum within a fixed sleeve which defines an annular chamber, and mixing tips mounted on the drum and in the annular chamber. The mixing tips pass through the hot mix asphalt laying in the bottom of the annular chamber and mix and shear the hot mix asphalt and increase its residence time in the drum mixer. In one preferred embodiment, the mixing tips may comprise curved scoop-like elements which lift the hot mix asphalt higher than conventional paddles and greatly increase residence time of the mix in the drum over conventional paddles. The quality of the mix is thus greatly improved. In another preferred embodiment the mixing tips may comprise curved scoop-like elements having slots which greatly increase sheering of the hot mix asphalt, thereby further improving the quality of the mix.

17 Claims, 3 Drawing Sheets

ASPHALT DRUM MIXER WITH CURVED SCOOP-LIKE MIXING TIPS

BACKGROUND OF THE INVENTION

1. Field of the Invention

The present invention relates generally to asphalt drum mixers. More particularly, the present invention relates to an asphalt drum mixer having improved mixing tips.

2. Background of the Related Art

Asphalt drum mixers having a counterflow dryer and a separate mixing device are required in some jurisdictions to meet strict air pollution laws. In these highly desirable asphalt drum mixers, the drum is constructed so that the heated gas flows counter to the direction of movement of the aggregate. A mixer of this type is disclosed in U.S. Pat. No. 4,867,572 to Brock et al. More particularly, in the drum mixer of the Brock et al. patent, a fixed sleeve surrounds the lower portion of the rotating drum so that the heated and dried aggregate is discharged into the annular chamber which is formed between the drum and sleeve. Also, an inlet is provided in the sleeve by which recycle asphalt pavement (RAP) may be introduced into the annular chamber, and another inlet is provided to introduce liquid asphalt into the annular chamber. The drum mounts mixing blades which are positioned in the annular chamber to mix the materials and cause them to be moved longitudinally to the discharge outlet of the sleeve.

The quality of the hot mix asphalt (HMA) is directly related to the quality of mixing in the annular chamber. Conventional mixing blades mounted on the drum are flat paddle-like elements mounted at approximately a 45° angle to the horizontal. As the mixing blades pass through the hot mix asphalt laying on the bottom of the annular chamber, they cause the hot mix asphalt to move longitudinally toward the discharge outlet but do not lift the hot mix asphalt to any appreciable degree.

SUMMARY OF THE INVENTION

An asphalt drum mixer having improved mixing tips is presented. The asphalt drum mixer of the present invention comprises a rotating drum within a fixed sleeve which defines an annular chamber and mixing means mounted on the drum and in the annular chamber. The mixing means pass through the hot mix asphalt laying in the bottom of the annular chamber and mix and shear the hot mix asphalt and increase its residence time in the drum mixer.

In one preferred embodiment, the mixing means may comprise curved scoop-like elements which lift the hot mix asphalt higher than conventional paddles and greatly increase residence time of the mix in the drum over conventional paddles. The quality of the mix is thus greatly improved. In another preferred embodiment the mixing tips may comprise curved scoop-like elements having slots or serrations which greatly increase sheering of the hot mix asphalt, thereby further improving the quality of the mix.

DETAILED DESCRIPTION OF THE PREFERRED EMBODIMENTS

Figure 1:
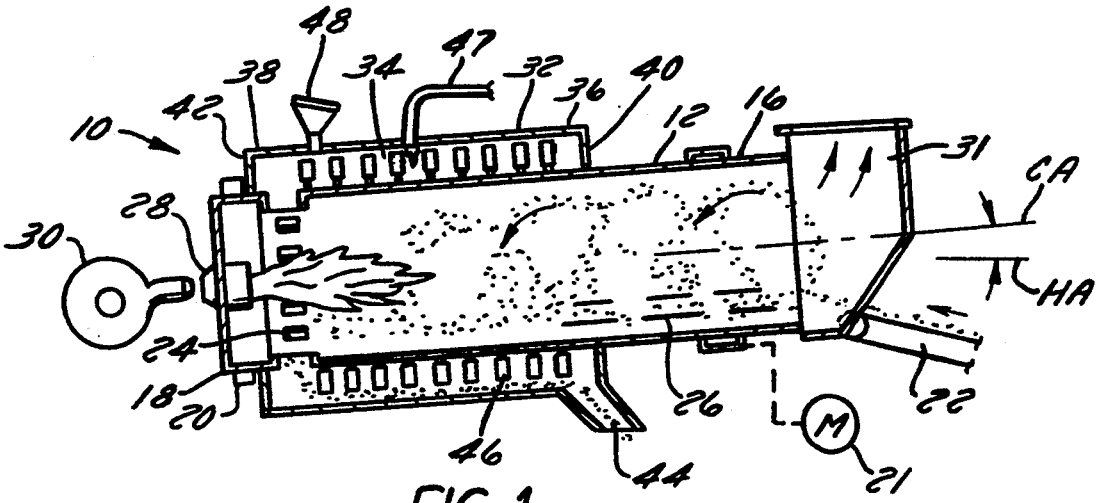
FIG. 1 is a sectioned side elevation view of a drum mixer which embodies the features of the present invention.

FIG. 1 illustrates a drum mixer 10 in accordance with one preferred embodiment of the present invention. The mixer 10 comprises an elongate hollow drum 12 defining a central axis (CA) inclined with respect to the horizontal axis (HA) so as to define an upper end 16 and a lower end 18 of the drum. FIG. 1 views the drum mixer from the side opposite that in FIGS. 4 and 5, and therefore the drum 12 appears to tilt in opposite directions in the two sets of figures.

The drum 12 is rotatably mounted on a frame (not shown) by means of bearings (not shown) mounted to the frame which engage races 20 which are mounted about the circumference of the drum. A motor (21) rotatably drives the drum in a conventional manner and as fully illustrated in U.S. Pat. No. 4,867,572 to Brock et al. incorporated herein by reference in its essentials. An aggregate inlet conveyor 22 is positioned adjacent the upper end 16 of the drum for introducing stone aggregate or the like into the interior of the drum. A plurality of outlet openings 24 are formed about the periphery of the drum at the lower end 18 as described further below.

A plurality of flights or vanes, a few of which are shown at 26, are mounted on the inside of the drum for lifting the aggregate and dropping it through the interior of the drum as it is rotated. Thus, the aggregate which is introduced into the drum via the inlet conveyor 22 is caused to cascade through the interior of the drum and move toward the outlet openings 24 at the lower end 18 of the drum.

The drum mixer 10 further includes a burner 28 which is mounted at the lower end of the drum for directing a high temperature flame into the interior of the drum. The burner 28 is of conventional design and includes a blower 30 which charges a mixture of fuel and air into the burner where it is ignited to produce a flame for heating the interior of the drum. An exhaust duct 31 is positioned at the upper end 16 of the drum and may include an exhaust fan (not shown) for exhausting the heated gas from the dram and so that the heated gas flows through the drum to heat the cascading aggregate. The exhaust air flow may be ducted to a conventional filtering bag house or other dust collector (not shown).

The drum mixer 10 further comprises a fixed sleeve 32 which is mounted coaxially about a portion of the length of the drum 12 adjacent the lower end 18 so that the drum 12 and sleeve 32 define an annular chamber 34 between them. The sleeve 32 is thus similarly inclined to the horizontal so as to define an upper end 36 and a lower end 38. The sleeve also includes annular Shoulders 40 and 42 at the upper and lower ends of the sleeve respectively. The shoulders 40,42 close the annular chamber 34 between the dram and the sleeve, and the lower end 38 of the sleeve 32 overlies the outlet openings 24 of the drum 12 so that the outlet openings open into the annular chamber 34. Thus, the heated and dried aggregate in the lower end of the drum falls into the annular chamber 34 during rotation of the drum 12. The sleeve 32 further includes a discharge opening 44 adjacent the upper end 36.

A plurality of flights or mixing tips 46 are mounted on the outer circumference of the drum 12 along the portion of the drum received within the sleeve 32. The tips 46 are configured and angled such that as the tips traverse the annular chamber 34 they engage the aggregate or hot mix asphalt in the annular chamber and move it toward the discharge opening 44 of the sleeve, while causing the aggregate to be mixed.

An inlet 48 positioned adjacent the lower end 38 of the sleeve 32 permits an additive such as RAP to be introduced into the annular chamber 34 to be mixed with the aggregate therein. Further, a liquid asphalt supply pipe 47 communicates with the annular chamber 34 for introducing liquid asphalt into the chamber so as to be mixed with the aggregate and the RAP therein. The resulting asphalt paving composition is discharged through the discharge opening 44 of the sleeve 32.

Figure 2:
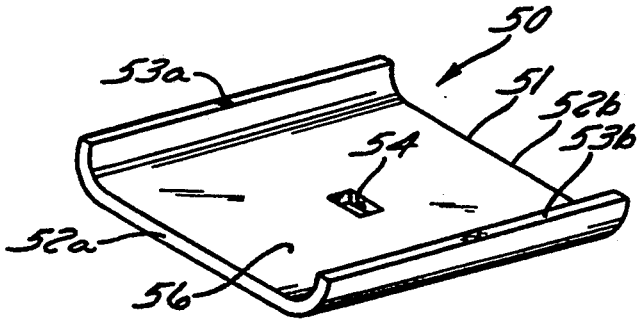
FIG. 2 is a perspective view of a mixing tip of the present invention.

Referring now to FIG. 2, an improved mixing tip 50 of the present invention is depicted. The mixing tip 50 comprises a shallow generally U-shaped rectangular element 51 having sides **52*a* and 52*b* and upturned ends 53*a* and 53*b*. A mounting hole 54 in the center of the mixing tip 50 is also shown. The ends 53*a* and 53*b* of mixing tip 50 are curved upwardly to form a shallow scoop, and the central portion 56** is generally flat.

Figure 3:
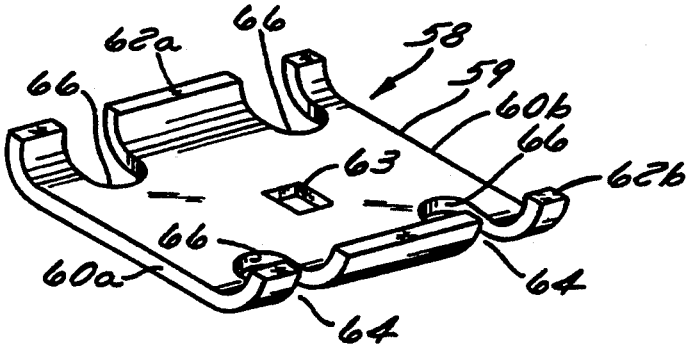
FIG. 3 is a perspective view of a mixing tip of the present invention.

Referring now to FIG. 3, another mixing tip 58 of the present invention is depicted. This alternative mixing tip 58 comprises a shallow generally U-shaped rectangular element 59 having sides **60*a* and 60*b* and upturned ends 62*a* and 62*b*. The alternative mixing tip is of the same general configuration as mixing tip 50 discussed above but with the addition of angled transverse slots 64 cutting through the upturned ends 62*a* and 62*b*. A mounting hole 63 is also shown. The slots, otherwise called serrations, are U-shaped at their ends 66**.

Figure 4:
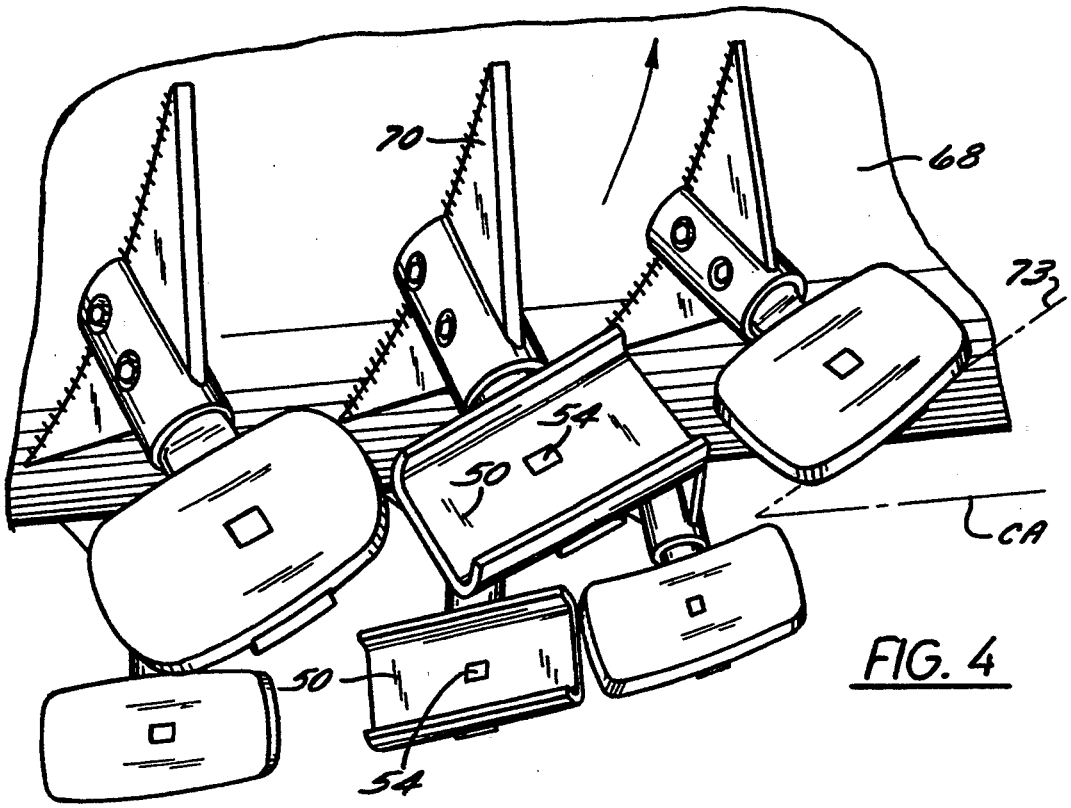
FIG. 4 is a perspective view of a mixing tip of the present invention mounted on the outer surface of the drum.

Referring now to FIG. 4, the mixing tips 50 of the present invention are shown mounted to the outside surface of a drum 68 on mounting brackets 70 at mounting hole 54. The mounting brackets 70 are conventional and orient the mixing tip 50 at an angle 73 of approximately 45° to the horizontal. As is well known, mixing tips mounted at this angle act as a segmental screw, moving the hot mix asphalt forward in the drum toward the discharge end.

Figure 5:
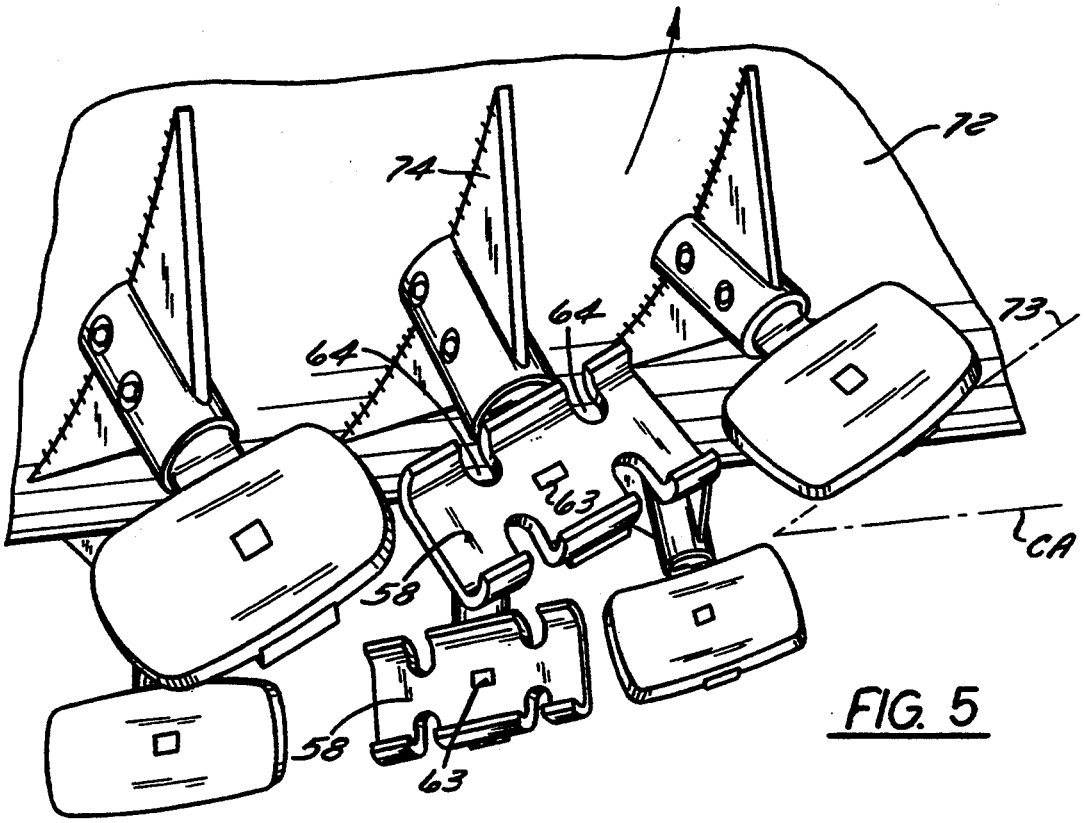
FIG. 5 is a perspective view of a mixing tip of the present invention mounted on the outer surface of the drum.

Referring now to FIG. 5, the mixing tips 58 of the present invention are shown mounted on the outer surface of drum 72 on mounting bracket 74 at mounting hole 63. The mixing tips 58 having slots 64 are mounted in a conventional manner. One of the benefits of the mixing tips of the present invention is that they may be put in place in the field in place of conventional mixing paddles thereby reducing down time and cost.

In operation, both of the mixing tips 50 and 58 of the present invention better mix the hot mix asphalt by virtue of their scoop-like design. The scoop-like design tends to hold the hot mix asphalt on the tip longer than occurs with a conventional mixing paddle. The curved ends **53*a* and 53*b* on mixing tip 50 and 62*a* and 62*b* on mixing tip 58** hold the hot mix asphalt on the mixing tip during a greater part of the revolution of the mixing tip around the annular chamber. As a consequence, the hot mix asphalt is lifted up and farther away from the bottom of the annular chamber thereby increasing residence time and promoting mixing. Of course, the exact depth of the scoop and shape of the mixing tips may be altered as needed for different drum sizes, hot mix asphalt compositions, or final product requirements.

If increased shearing as well as mixing of the hot mix asphalt is desired, it is preferable to use the mixing tips 58 of the present invention. Hot mix asphalt shears through the transverse slots 64 in the upturned ends **62*a* and 62*b* as the mixing tips 58 travel through the hot mix asphalt in the bottom of the annular chamber 34 as the drum rotates 12. It can be seen from FIG. 5 that the slots 64 are at an angle through the mixing tip 58 such that when the mixing tip 58 is mounted on mounting brackets 74 the slots allow hot mix asphalt to readily drop through the slots by the force of gravity. The slots may be cut in the mixing tips 58 so as to align with vertical as the mixing tips travel vertically out of the hot mix asphalt in the bottom of the annular chamber and upward as the drum 72** rotates.

The exact proportions of the slots 64 to the remaining body of the mixing tip 58 may be altered in accordance with drum size, hot mix asphalt composition, or the final product mix desired. Also, the specific location of the mixing tips of the present invention on the outer surface of the drum 12 may be varied in accordance with the degree of mixing and/or sheering of the hot mix asphalt desired. Just a few of the mixing tips of the present invention may be spaced about the drum, replacing conventional mixing paddles to enhance mixing. If an extremely high degree of mixing and sheering is desired, the mixing tips of the present invention may comprise the majority or all of the mixing means on the outer surface of the drum in the annular chamber.

A typical cycle of operation can be described as follows. Referring again to FIG. 1, virgin aggregate enters the drum 12 on the conveyor 22 and travels toward the burner 28. Hot aggregate falls from the rotating drum 12 into the annular chamber 34 through the outlets 24 at the lower end 18 of the drum. The virgin aggregate is quickly moved away from the outlet 24 by screw flights (not shown) toward the tips 46 which, acting as a segmental screw, continue to move the material toward the discharge opening 44. At selected locations on the drum, the mixing tips 50 and 58 sheer through the flow of hot mix. Sheering is particularly achieved by the slots 64 in mixing tips 58. The curved ends 62A and 62B scoop hot mix asphalt at the bottom of the annular chamber 34 as they sheer through the mix lifting the mix up and allowing a steady stream of mix to fall through the slots 64. Sheering between the liquid and the aggregate is maximized as the hot mix drops through the slots 64. This provides an excellent mixing action which surpasses that possible in a single shaft mixer.

Figure 6:
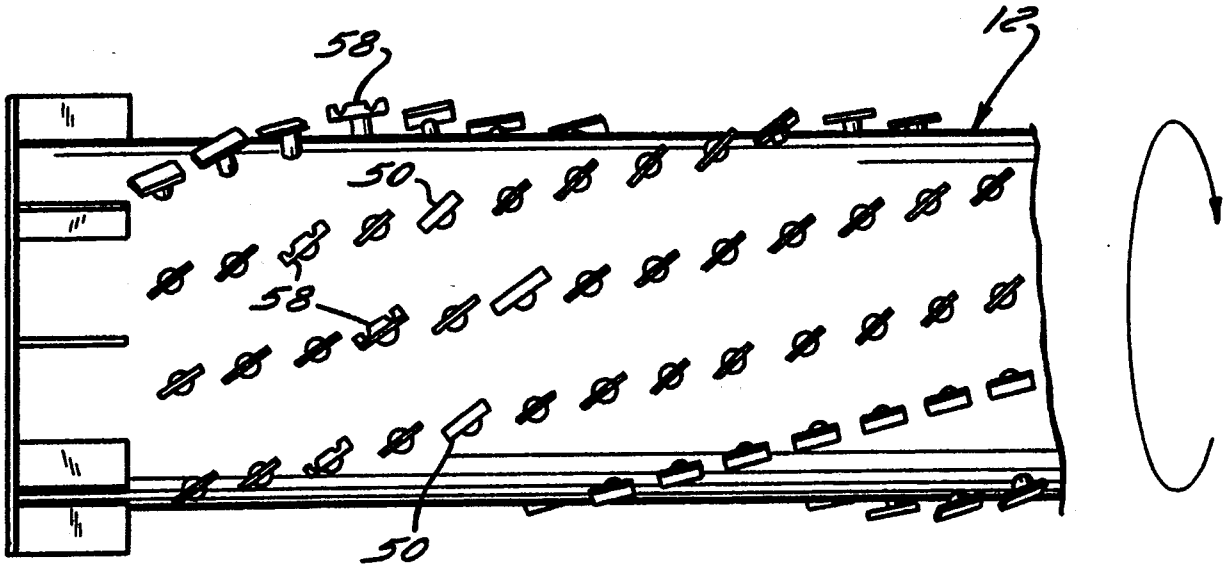
FIG. 6 is a side perspective view of an asphalt drum mixer of the present invention and showing the mixing tips of the present invention mounted on the outside surface of the drum alongside conventional mixing paddles.

It can also be seen from FIG. 6 that the mixing tips 50 and 58 act to increase residence time of the hot mix asphalt in the annular chamber. The mixing tips act to lift up the hot mix asphalt in a direction perpendicular to the direction of forward travel, which increases the residence time of the hot mix asphalt in the drum. This increased residence time provides additional opportunity for sheering and mixing of the hot mix asphalt.

It is to be understood that embodiments of the present invention not disclosed herein are fully intended to be within the scope of the appended claims.

I claim:

1. A drum mixer for heating and drying stone aggregate in the continuous production of asphalt paving composition, said drum mixer comprising:

an elongate hollow rotatable drum having a length and defining a central axis, said elongate hollow rotatable drum comprising a plurality of outlet openings for the heated and dried stone aggregate, said plurality of outlet openings being formed about a periphery of said hollow rotatable drum at a lower axial end of said elongate hollow rotatable drum;

a burner which is located adjacent the lower axial end of said elongate hollow rotatable drum and which directs a flame axially into said elongate hollow rotatable drum;

a fixed sleeve mounted coaxially about at least a portion of the length of said hollow rotatable drum and so as to define an annular chamber between said hollow rotatable drum and said fixed sleeve, said annular chamber defining an average residence time of hot mix asphalt in said annular chamber, said fixed sleeve comprising a discharge opening for hot mix asphalt, said discharge opening being formed adjacent an upper end of said fixed sleeve;

a liquid asphalt supply pipe connected to said annular chamber for introducing liquid asphalt into the annular chamber so that liquid asphalt combines with, and is mixed with, the heated and dried stone aggregate to create hot mix asphalt; and means for mixing hot mix asphalt in said annular chamber, said means comprising curved scoop mixing tips mounted on said drum in said annular chamber and spaced apart from said fixed sleeve, said mixing tips defining means for lifting said hot mix asphalt up in a direction perpendicular to a direction of forward travel so as to increase the residence time of said hot mix asphalt in said annular chamber over said average residence time.

2. The invention as defined in claim 1 wherein said mixing tips comprise elongate U-shaped members.

3. A drum mixer for heating and drying stone aggregate in the continuous production of asphalt paving composition, said drum mixer comprising:

an elongate hollow rotatable drum defining a central axis;

a fixed sleeve mounted coaxially about at least a portion of the length of said drum and so as to define an annular chamber between said drum and said sleeve, said annular chamber defining an average residence time of hot mix asphalt;

means for mixing hot mix asphalt in said annular chamber, said means comprising curved scoop-like mixing tips mounted on said drum in said annular chamber, said mixing tips defining means for lifting said hot mix asphalt up and for increasing the residence time of said hot mix asphalt in said annular chamber over said average residence time, wherein said mixing tips have a flat central portion and first and second ends, said first and second ends being upturned with respect to said flat central portion; and a burner which is located adjacent an axial end of said drum and which directs a flame axially into said drum.

4. The invention as defined in claim 3 further characterized in that said mixing tips have angled transverse slots in said upturned first and second ends which increase shearing of said hot mix asphalt.

5. A drum mixer for heating and drying stone aggregate in the continuous production of asphalt paving composition, said drum mixer comprising:

an elongate hollow rotatable drum defining a central axis;

a fixed sleeve mounted coaxially about at least a portion of the length of said drum and so as to define an annular chamber between said elongate hollow rotatable drum and said fixed sleeve, said annular chamber defining an average residence time of hot mix asphalt; and means for mixing hot mix asphalt in said annular chamber, said means for mixing comprising curved scoop mixing tips mounted on said elongate hollow rotatable drum in said annular chamber, said curved scoop mixing tips defining means for lifting said hot mix asphalt up and for increasing the residence time of said hot mix asphalt in said annular chamber over said average residence time wherein said curved scoop mixing tips comprise elongate U-shaped members and wherein said means for mixing hot mix asphalt comprises a plurality of rows of paddles mounted on said elongate hollow drum, said rows being at an angle to the central axis of the drum and said paddles in each of said rows being mounted at an angle to each of said rows, said curved scoop mixing tips being mounted at selected locations in each of said rows and taking the place of one paddle at each of said selected locations.

6. The invention as defined in claim 5 wherein said mixing tips have a central portion having a longitudinal axis, said longitudinal axis of said mixing tips being at an angle to said rows which is equal to the angle that each of said paddles makes with respect to said rows.

7. The invention as defined in claim 5 wherein said mixing tips are mounted toward a discharge end of said sleeve.

8. The invention as defined in claim 5 wherein each said row has at least two said mixing tips.

9. A drum mixer adapted for heating and drying stone aggregate in the continuous production of hot mix asphalt, and comprising an elongate hollow drum defining a central axis, said central axis being inclined with respect to the horizontal so as to define an upper end and a lower end of said drum, aggregate inlet means positioned adjacent said upper end of said drum for introducing aggregate into the interior of said drum, aggregate outlet means positioned adjacent said lower end of said drum for withdrawing the aggregate from the interior of said drum, means for rotating said drum about said central axis so as to cause the aggregate which is introduced at said inlet means to cascade through the interior of said drum and move to said outlet means, heating means positioned adjacent one of said ends of said drum for introducing heated gas into the interior of said drum, exhaust duct means positioned adjacent the other of said ends of said drum for exhausting the heated gas therefrom and so that the heated gas flows through said drum and through the cascading aggregate, a fixed sleeve mounted coaxially about at least a portion of the length of said drum and so as to define an annular chamber between said drum and said sleeve, said sleeve having a lower end overlying said outlet means of said drum and an upper end positioned intermediate said ends of said drum, with said outlet means of said drum opening into said annular chamber so that said annular chamber receives the heated and dried aggregate from said outlet means, and with said sleeve further including a discharge opening adjacent said upper end thereof, mixing means mounted to the exterior of said drum so as to be positioned within said annular chamber for lifting and mixing the aggregate received therein upon rotation of said drum and moving the aggregate toward said discharge opening of said sleeve, and said mixing means comprising generally elongate U-shaped members each having a generally flat central portion and two ends, said ends being curved with respect to said generally flat central portion for mixing and sheering said aggregate.

10. The invention as defined in claim 9 wherein said ends of said U-shaped members are upturned with respect to said flat central portion.

11. The invention as defined in claim 10 further characterized in that said mixing means have angled transverse slots in said ends of said U-shaped members which increase shearing of said hot mix asphalt.

12. The invention as defined in claim 9 further comprising means positioned adjacent said lower end of said sleeve for introducing an additive into said annular chamber so as to be mixed with the aggregate therein.

13. The invention as defined in claim 12 further comprising means for introducing liquid asphalt into said annular chamber so as to be mixed with the aggregate and the additive therein.

14. The invention as defined in claim 12 wherein said heating means comprises a burner for directing a high temperature flame into said drum, and airblower means for supplying air to said burner.

15. A drum mixer comprising:

an elongate hollow rotatable drum defining a central axis;

a sleeve mounted about at least a portion of the length of said drum so as to define an annular chamber between said drum and said sleeve;

a plurality of curved scoop-like mixing tips mounted on said drum in said annular chamber, each of said mixing tips having a flat central portion and first and second ends, said first and second ends being upturned with respect to said flat central portion; and a burner which is located adjacent an axial end of said drum and which directs a flame axially into said drum.

16. The invention as defined in claim 15 wherein said sleeve is a fixed sleeve.

17. The invention as defined in claim 16 wherein said sleeve is coaxial with said drum.

* * * * *